US011535427B2

(12) United States Patent
Wang

(10) Patent No.: US 11,535,427 B2
(45) Date of Patent: Dec. 27, 2022

(54) CUP

(71) Applicant: Shanghai Dream Houseware CO., Ltd., Shanghai (CN)

(72) Inventor: Zengyu Wang, Shanghai (CN)

(73) Assignee: SHANGHAI DREAM HOUSEWARE CO., LTD., Shanghai (CN)

( * ) Notice: Subject to any disclaimer, the term of this patent is extended or adjusted under 35 U.S.C. 154(b) by 0 days.

(21) Appl. No.: 17/242,328

(22) Filed: Apr. 28, 2021

(65) Prior Publication Data

US 2021/0347532 A1 Nov. 11, 2021

(30) Foreign Application Priority Data

May 8, 2020 (CN) ..... 202020737655.8

(51) Int. Cl.
*B65D 43/02* (2006.01)
*A47G 19/22* (2006.01)
*B65D 51/24* (2006.01)

(52) U.S. Cl.
CPC ..... *B65D 43/0225* (2013.01); *A47G 19/2205* (2013.01); *B65D 51/242* (2013.01); *B65D 2543/00092* (2013.01); *B65D 2543/00231* (2013.01); *B65D 2543/00518* (2013.01); *B65D 2543/00537* (2013.01); *B65D 2543/00555* (2013.01)

(58) Field of Classification Search
CPC ..... A47G 19/2205; A47G 19/2288; B65D 43/0225; B65D 51/242; B65D 2543/00092; B65D 2543/00231; B65D 2543/00518; B65D 2543/00537; B65D 2543/00555; B65D 2543/0049; B65D 2543/00481; A45F 3/16
USPC ..... 220/288
See application file for complete search history.

(56) References Cited

FOREIGN PATENT DOCUMENTS

CN 103723351 A * 4/2014 ..... B65D 41/02
CN 210446551 U * 5/2020

* cited by examiner

*Primary Examiner* — Valentin Neacsu
*Assistant Examiner* — Eric C Baldrighi
(74) *Attorney, Agent, or Firm* — Bayramoglu Law Offices LLC

(57) ABSTRACT

A cup includes a cup body and a cup lid. The interior of the cup body is hollow, and the top of an inner wall of the cup body is provided with a connecting piece. The cup lid is covered on the cup body. The cup lid includes an inner layer cylinder, a sandwich cylinder sleeved on the inner layer cylinder, an outer layer cylinder sleeved and clamped on an upper portion of the sandwich cylinder, a first sealing ring with an elasticity sleeved on a lower portion of the sandwich cylinder, a sealing cap detachably mounted at the bottom of the sandwich cylinder, and a cap shell covered to the outer layer cylinder and fixedly connected to the inner layer cylinder. A cylinder wall of the outer layer cylinder is provided with a connecting groove corresponding to the connecting piece.

12 Claims, 7 Drawing Sheets

CUP

CROSS REFERENCE TO THE RELATED APPLICATIONS

This application is based upon and claims priority to Chinese Patent Application No. CN 202020737655.8, filed on May 8, 2020, the entire contents of which are incorporated herein by reference.

TECHNICAL FIELD

The present invention relates to the technical field of daily necessities, and more particularly, to a cup.

BACKGROUND

The cup lid and the cup body of the thermos cup in the market are usually connected by threads, and the cup lid needs to be operated for several rotations to open or close the cup lid on the cup body, which is very inconvenient. Moreover, since the cup lid cannot be disassembled, the interior of the cup lid easily accumulates water, is difficult to clean thoroughly, and becomes a breeding ground for bacteria.

Therefore, in order to solve the above technical problems, it is highly desirable to provide a cup which is effortless to open or close and convenient to clean the interior of the cup lid.

SUMMARY

An objective of the present invention is to provide a cup, aimed to overcome the shortcomings of the prior art, so as to solve the existing problems of the inconvenient operation of opening or closing a cup lid and the inability of cleaning the interior of the cup lid.

To achieve the above objective, the present invention provides a cup, including a cup body and a cup lid.

The interior of the cup body is hollow, and the top of an inner wall of the cup body is provided with a connecting piece.

The cup lid is covered on the cup body. The cup lid includes an inner layer cylinder, a sandwich cylinder sleeved on the inner layer cylinder, an outer layer cylinder sleeved and clamped on the upper portion of the sandwich cylinder, a first sealing ring with elasticity sleeved on the lower portion of the sandwich cylinder, a sealing cap detachably mounted at the bottom of the sandwich cylinder, and a cap shell covered to the outer layer cylinder and fixedly connected to the inner layer cylinder. A cylinder wall of the outer layer cylinder is provided with a connecting groove corresponding to the connecting piece. The connecting piece can be clamped in the connecting groove, so that the cup lid can be opened or closed on the cup body. An inner wall of the sandwich cylinder is provided with a protruding block, and a cylinder wall of the inner layer cylinder is provided with an arc-shaped inclined groove corresponding to the protruding block. The protruding block is slidably disposed in the inclined groove, and the sandwich cylinder is clamped in the inner layer cylinder. The inclined groove includes a first end portion and a second end portion, and the height of the first end portion is higher than the height of the second end portion. The sandwich cylinder can move up and down relative to the outer layer cylinder. The top of the first sealing ring is fixedly connected to the bottom of the outer layer cylinder, and the bottom of the first sealing ring is sandwiched and fixed between the bottom of the sandwich cylinder and the sealing cap. The sealing cap can be mounted to or detached from the sandwich cylinder by rotating the sealing cap.

When the cup lid is covered on the cup body, the cup lid extends into the cup body, the connecting piece enters and is clamped in the connecting groove, the cap shell is rotated to drive the inner layer cylinder to rotate, the protruding block at the second end portion moves toward the first end portion, so that the sandwich cylinder drives the first sealing ring to move upward and squeezes the first sealing ring to bulge outward, and the first sealing ring is tightly attached to the inner wall of the cup body.

When the cup lid is screwed out of the cup body, the cap shell is rotated to drive the inner layer cylinder to rotate, the protruding block at the first end portion moves toward the second end portion, so that the sandwich cylinder drives the first sealing ring to move downward and decompresses the first sealing ring, and the first sealing ring moves away from the inner wall of the cup body to allow the cup lid to be pulled out of the cup body.

In the present invention, the connecting piece is clamped in the connecting groove to enable the outer layer cylinder to be restricted to the cup body. By means of the cooperation between the protruding block and the inclined groove, the inner layer cylinder drives the sandwich cylinder to move upward or downward to squeeze or decompress the first sealing ring, so that the first sealing ring is tightly attached to or moves away from the inner wall of the cup body. In this way, the cup lid can be opened or closed on the cup body by rotating at a small angle. In addition, the sealing cap can be mounted to or detached from the sandwich cylinder by rotating the sealing cap, so that the interior of the cup lid can be conveniently cleaned to prevent bacteria from breeding. Moreover, the sandwich cylinder moves upward and squeezes the first sealing ring to bulge outward, so that the first sealing ring can be tightly attached to the inner wall of the cup body, which increases the sealing of the cup lid covered on the cup body.

As an improved solution of the cup of the present invention, the sealing cap includes a base and a vertical cylinder erected on the base. The top of an outer wall of the vertical cylinder is provided with a clamping strip.

The sandwich cylinder includes a bottom plate, and the bottom plate is provided with an assembly hole through which the vertical cylinder passes. An inner wall of the assembly hole is provided with a sliding groove adapted to the clamping strip, and the sliding groove is inclined. One end of the sliding groove is located at the top surface of the bottom plate, and the other end of the sliding groove is provided with a clamping groove adapted to the clamping strip and facing downward. When the sealing cap is mounted to the sandwich cylinder, the vertical cylinder is inserted into the assembly hole, and the sealing cap is rotated, so that the clamping strip enters the sliding groove, moves to the clamping groove along the sliding groove, and is clamped in the clamping groove.

When the sealing cap is detached from the sandwich cylinder, the sealing cap is rotated, so that the clamping strip is separated from the clamping groove, moves into the sliding groove, and is separated from the sliding groove.

As an improved solution of the cup of the present invention, the cup further includes a second sealing ring with elasticity. The bottom of the sandwich cylinder is provided with a clamping groove corresponding to the second sealing ring, and the second sealing ring is sandwiched and fixed between the clamping groove and the sealing cap.

As an improved solution of the cup of the present invention, the bottom of the sandwich cylinder is recessed inward to form a fixing portion corresponding to the first sealing ring, and the bottom of the first sealing ring is bent and sandwiched between the fixing portion and the sealing cap.

As an improved solution of the cup of the present invention, the first sealing ring includes a sealing groove formed at the top of the first sealing ring, a first sealing strip and a second sealing strip. The first sealing strip and the second sealing strip are formed on both sides of the sealing groove.

The bottom of the outer layer cylinder is provided with a protruding portion, and the protruding portion is clamped in the sealing groove.

The top of an outer wall of the sandwich cylinder is provided with a flange corresponding to the first sealing strip, and the first sealing strip is sandwiched between the flange, the side wall of the sandwich cylinder and the protruding portion.

As an improved solution of the cup of the present invention, the inner wall of the cup body is provided with a waterproof rib corresponding to the first sealing ring, and the first sealing ring is squeezed to bulge outward to be tightly attached to the waterproof rib.

As an improved solution of the cup of the present invention, the cup further includes a third sealing ring with elasticity. The top of the cylinder wall of the outer layer cylinder is provided with a first blocking ring and a second blocking ring corresponding to the third sealing ring, and the third sealing ring is sleeved on the outer layer cylinder and is sandwiched between the first blocking ring and the second blocking ring.

The top of an outer wall of the inner layer cylinder is provided with a positioning plate, and the top of the cylinder wall of the outer layer cylinder is provided with a positioning groove corresponding to the positioning plate. An end portion of the positioning plate passes through the positioning groove and abuts against the third sealing ring. The cap shell is rotated to drive the inner layer cylinder to rotate, so that the positioning plate can slide in the positioning groove.

The side of the third sealing ring away from the positioning plate abuts against the cap shell.

As an improved solution of the cup of the present invention, the top of the cup body is provided with a mounting portion, and a mounting groove is formed between the outer layer cylinder and the cap shell. The mounting portion is mounted in the mounting groove.

As an improved solution of the cup of the present invention, the bottom of the outer layer cylinder is provided with an opening in communication with the connecting groove, and the width of the opening is smaller than the width of the connecting groove. The cup lid is rotated, and the connecting piece enters the connecting groove through the opening and then moves away from the opening, so that the connecting piece is restricted to the connecting groove to allow the cup lid to be covered on the cup body.

As an improved solution of the cup of the present invention, the outer wall of the sandwich cylinder is provided with a first limiting piece, and an inner wall of the outer layer cylinder is provided with a first limiting groove corresponding to the first limiting piece. The first limiting piece is slidably disposed in the first limiting groove.

The inner wall of the outer layer cylinder is provided with a second limiting piece, and a cylinder wall of the sandwich cylinder is provided with a second limiting groove corresponding to the second limiting piece. The second limiting piece is slidably disposed in the second limiting groove.

DETAILED DESCRIPTION OF THE EMBODIMENTS

In order to make the objectives, technical solutions and advantages of the present invention more clear, the present invention will be further described in detail below in conjunction with the drawings and embodiments. It should be understood that the specific embodiments described herein are intended to explain the present invention only and are not intended to limit the present invention. Based on the embodiments of the present invention, all other embodiments obtained by those having ordinary skill in the art without exerting creative effort shall fall within the scope of protection of the present invention.

The present invention provides a cup, including a cup body and a cup lid. The cup lid includes an inner layer cylinder, a sandwich cylinder, an outer layer cylinder, a first sealing ring, a sealing cap and a cap shell. A connecting piece is clamped in a connecting groove to enable the outer layer cylinder to be restricted to the cup body. By means of the cooperation between a protruding block and an inclined groove, the inner layer cylinder drives the sandwich cylinder to move upward or downward to squeeze or decompress a first sealing ring, so that the first sealing ring is tightly attached to or moves away from the inner wall of the cup body. In this way, the cup lid can be opened or closed on the cup body by rotating at a small angle. In addition, the sealing cap can be mounted to or detached from the sandwich cylinder by rotating the sealing cap, so that the interior of the cup lid can be conveniently cleaned to prevent bacteria from breeding. Moreover, the sandwich cylinder moves upward and squeezes the first sealing ring to bulge outward, so that the first sealing ring can be tightly attached to the inner wall of the cup body, which increases the sealing of the cup lid covered on the cup body.

The cup of the present invention will be explained below with reference to the drawings.

Figure 1:
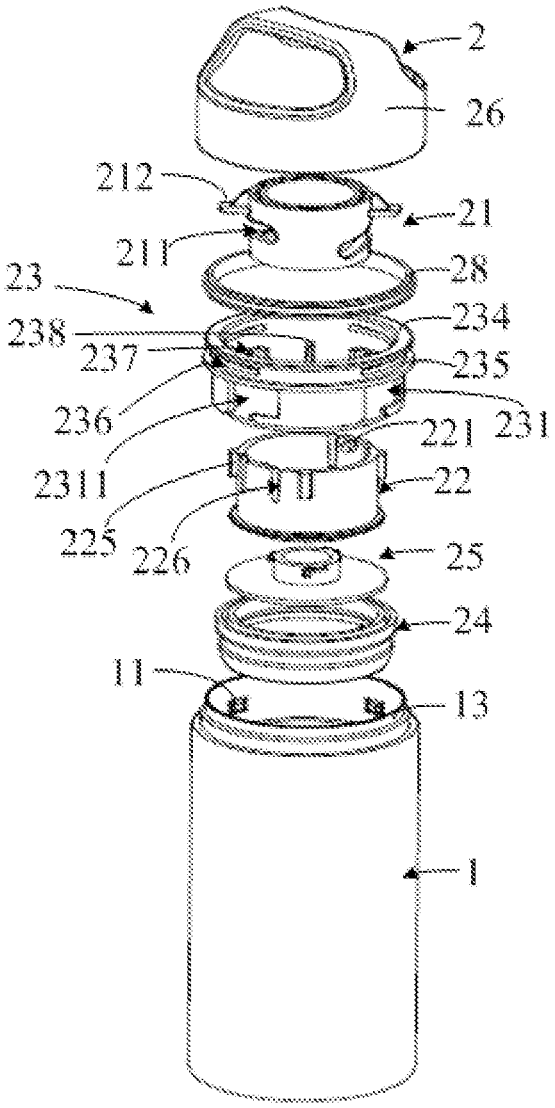
FIG. 1 is an exploded diagram of a cup according to the present invention.

FIG. 1 shows an exploded diagram of a cup of the present invention. In an embodiment of the present invention, a cup includes the cup body 1 and the cup lid 2. The interior of the cup body 1 is hollow, and the top of the inner wall of the cup body 1 is provided with the connecting piece 11. The cup lid 2 is covered on the cup body 1. The cup lid 2 includes the inner layer cylinder 21, the sandwich cylinder 22 sleeved on the inner layer cylinder 21, the outer layer cylinder 23 sleeved and clamped on the upper portion of the sandwich cylinder 22, the first sealing ring 24 with elasticity sleeved on the lower portion of the sandwich cylinder 22, the sealing cap 25 detachably mounted at the bottom of the sandwich cylinder 22, and the cap shell 26 covered to the outer layer cylinder 23 and fixedly connected to the inner layer cylinder 21. The sealing cap 25 is rotated, so that the sealing cap 25 can be mounted to or detached from the sandwich cylinder 22. The cylinder wall of the outer layer cylinder 23 is provided with the connecting groove 231 corresponding to the connecting piece 11, and the connecting piece 11 can be clamped in the connecting groove 231, so that the cup lid 2 can be opened or closed on the cup body 1. The inner wall of the sandwich cylinder 22 is provided with the protruding block 221, and the cylinder wall of the inner layer cylinder 21 is provided with the arc-shaped inclined groove 211 corresponding to the protruding block 221. The protruding block 221 is slidably disposed in the inclined groove 211, so that the sandwich cylinder 22 is clamped in the inner layer cylinder 21. The inclined groove 211 includes a first end portion and a second end portion, and the height of the first end portion is higher than the height of the second end portion. The sandwich cylinder 22 can move up and down relative to the outer layer cylinder 23. The top of the first sealing ring 24 is fixedly connected to the bottom of the outer layer cylinder 23, and the bottom of the first sealing ring 24 is sandwiched and fixed between the bottom of the sandwich cylinder 22 and the sealing cap 25. Specifically, four connecting pieces 11 are uniformly arranged, and four connecting grooves 231 are uniformly arranged.

Figure 6:
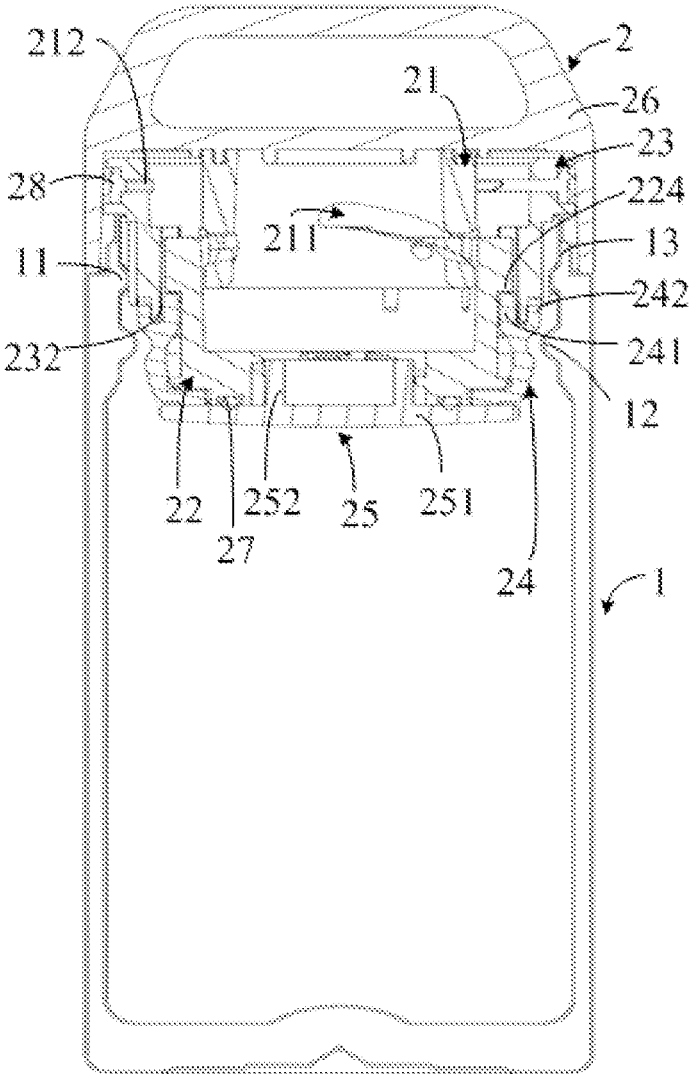
FIG. 6 is a structural schematic diagram of the cup when the cup lid is opened on the cup body according to the present invention.
Figure 7:
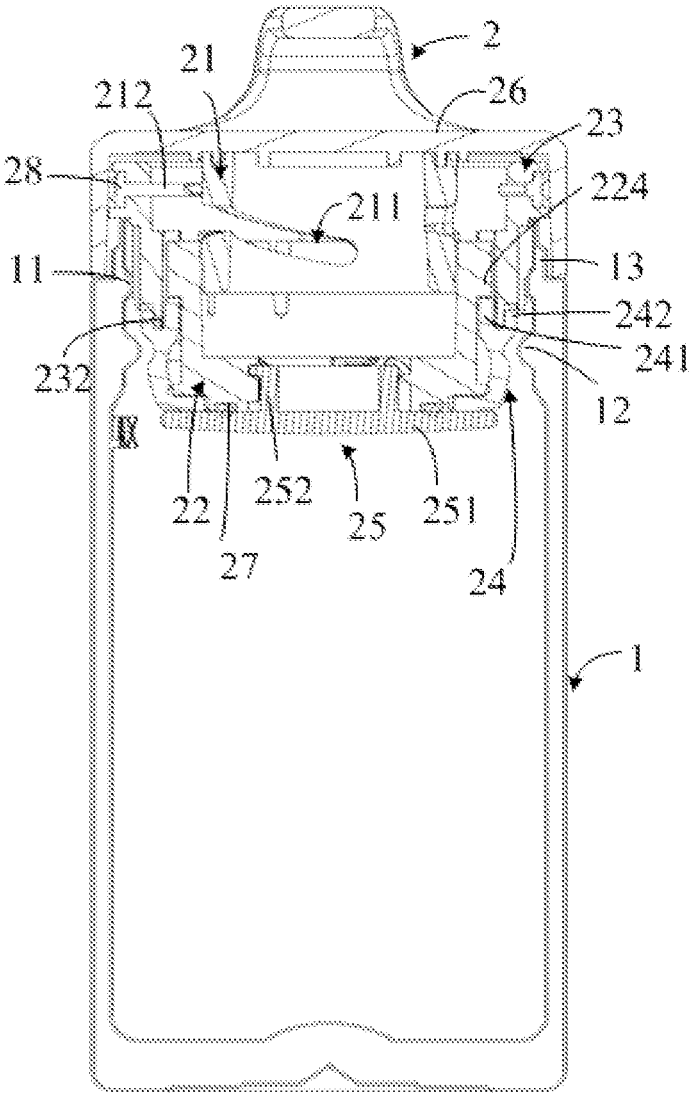
FIG. 7 is a cross-sectional view of the cup when the cup lid is opened on the cup body according to the present invention.

Referring to FIGS. 6 and 7, when the cup lid 2 is covered on the cup body 1, the cup lid 2 extends into the cup body 1, so that the connecting piece 11 enters and is clamped in the connecting groove 231. The cap shell 26 is rotated to drive the inner layer cylinder 21 to rotate, and the protruding block 221 at the second end portion moves toward the first end portion, so that the sandwich cylinder 22 drives the first sealing ring 24 to move upward and squeezes the first sealing ring 24 to bulge outward, and the first sealing ring 24 is enabled to be tightly attached to the inner wall of the cup body 1.

Figure 4:
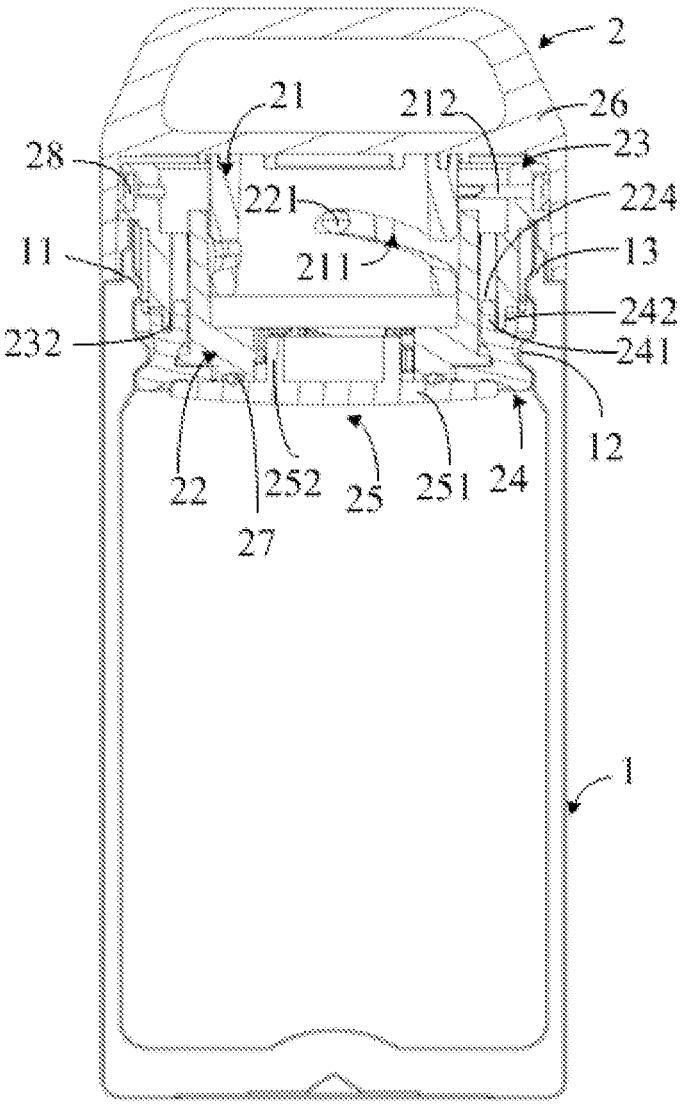
FIG. 4 is a structural schematic diagram of the cup when the cup lid is closed on a cup body according to the present invention.
Figure 5:
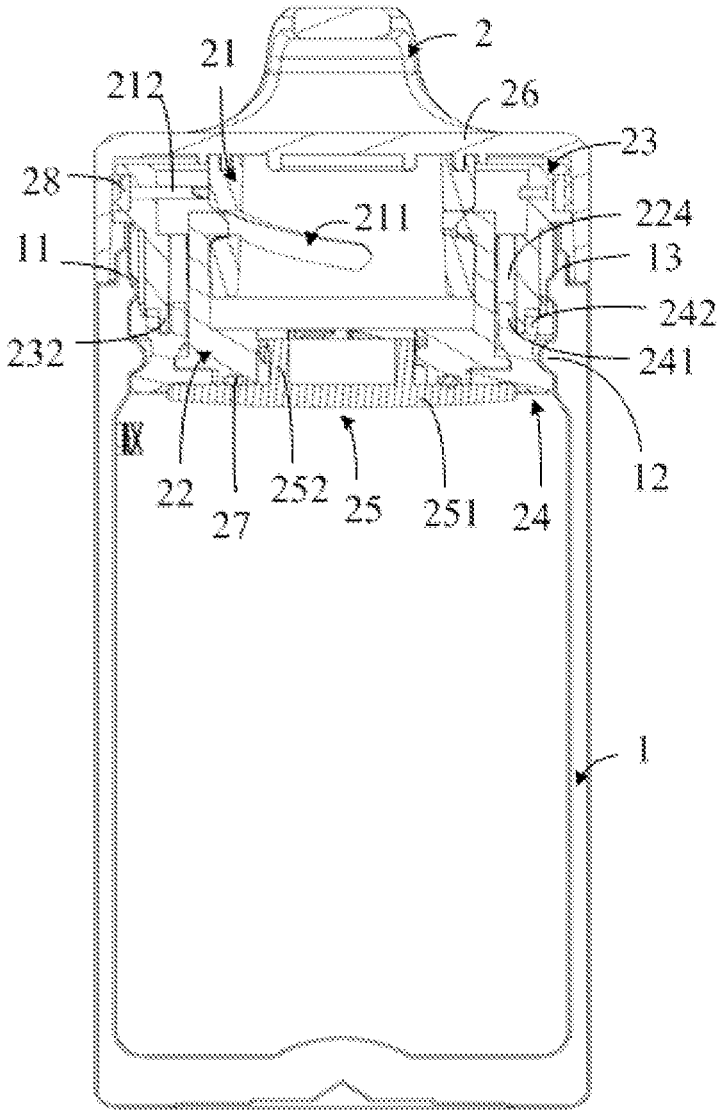
FIG. 5 is a cross-sectional view of the cup when the cup lid is closed on the cup body according to the present invention.

Referring to FIGS. 4 and 5, when the cup lid 2 is screwed out of the cup body 1, the cap shell 26 is rotated to drive the inner layer cylinder 21 to rotate, and the protruding block 221 at the first end portion moves toward the second end portion, so that the sandwich cylinder 22 drives the first sealing ring 24 to move downward and decompresses the first sealing ring 24, and the first sealing ring 24 is enabled to move away from the inner wall of the cup body 1 to enable the cup lid 2 to be pulled out of the cup body 1.

In the present invention, the connecting piece 11 is clamped in the connecting groove 231 to enable the outer layer cylinder 23 to be restricted to the cup body 1. By means of the cooperation between the protruding block 221 and the inclined groove 211, the inner layer cylinder 21 drives the sandwich cylinder 22 to move upward or downward to squeeze or decompress the first sealing ring 21, so that the first sealing ring 24 is tightly attached to or moves away from the inner wall of the cup body 1. In this way, the cup lid 2 can be opened or closed on the cup body 1 by rotating at a small angle. In addition, the sealing cap 25 can be mounted to or detached from the sandwich cylinder 22 by rotating the sealing cap 25, so that the interior of the cup lid 2 can be conveniently cleaned to prevent bacteria from breeding. Moreover, the sandwich cylinder 22 moves upward and squeezes the first sealing ring 24 to bulge outward, so that the first sealing ring 24 can be tightly attached to the inner wall of the cup body 1, which increases the sealing of the cup lid 2 covered on the cup body.

Figure 2:
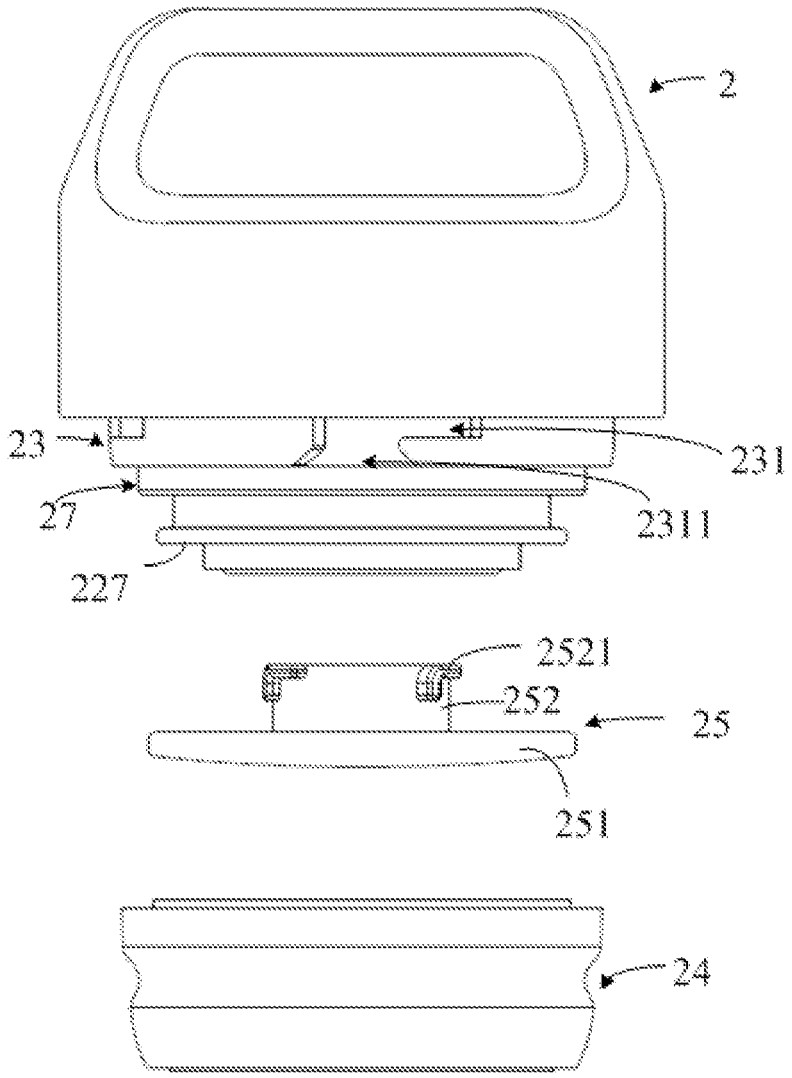
FIG. 2 is a structural schematic diagram of a cup lid of the cup according to the present invention.
Figure 3:
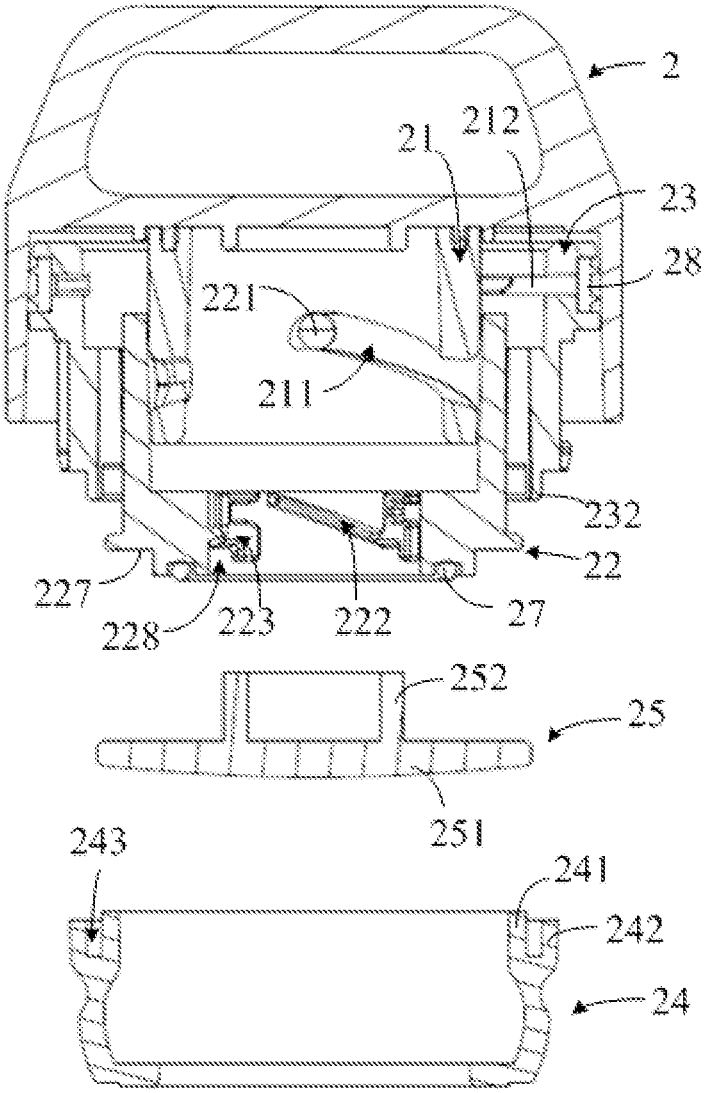
FIG. 3 is a cross-sectional view of the cup lid of the cup according to the present invention.

Referring to FIGS. 2 and 3, further, the sealing cap 25 includes the base 251 and the vertical cylinder 252 erected on the base 251. The vertical cylinder 252 and the base 251 form a water storage space for storing water in the cup lid 2. The bottom of the inner wall of the sandwich cylinder 22 is provided with the sliding groove 222 corresponding to the clamping strip 2521, and the clamping strip 2521 is movable in the sliding groove 222. The sliding groove 222 includes a first end head and a second end head, and the height of the first end head is higher than the height of the second end head. The first end head is in communication with an inner cavity of the sandwich cylinder 22. The bottom of the inner wall of the sandwich cylinder 22 located at the second end head is provided with the clamping groove 223 adapted to the clamping strip 2521. The clamping groove 223 is communication with the sliding groove 222, and the height of the clamping groove 223 lower than the height of the second end head. The sandwich cylinder 22 includes a bottom plate, and the bottom plate is provided with the assembly hole 228 through which the vertical cylinder passes. The inner wall of the assembly hole 228 is provided with the sliding groove 222 adapted to the clamping strip, and the sliding groove 222 is inclined. One end of the sliding groove 222 is located at the top surface of the bottom plate, and the other end of the sliding groove 222 is provided with the clamping groove 223 adapted to the clamping strip 2521 and facing downward. When the sealing cap 25 is mounted to the sandwich cylinder 22, the vertical cylinder 252 is inserted into the assembly hole 228, and the sealing cap 25 is rotated, so that the clamping strip 2521 enters the sliding groove 222, moves along the sliding groove 222 to the clamping groove 223, and is clamped in the clamping groove 223. When the sealing cap 25 is detached from the sandwich cylinder 22, the sealing cap 25 is rotated, so that the clamping strip 2521 is separated from the clamping groove 223, moves into the sliding groove 222, and is separated from the sliding groove 222. The sealing cap 25 can be mounted to or detached from the sandwich cylinder 22 by rotating the sealing cap 25, so that the interior of the cup lid 2 can be conveniently cleaned to prevent bacteria from breeding. Specifically, three clamping strips 2521 are uniformly arranged, and three sliding grooves 222 are uniformly arranged.

Referring to FIGS. 2 and 3, in an embodiment of the present invention, the water cup further includes the second sealing ring 27 with elasticity. The bottom of the sandwich cylinder 22 is provided with a clamping groove corresponding to the second sealing ring 27. The second sealing ring 27 is sandwiched and fixed between the clamping groove and the sealing cap 25 to increase the sealing between the sealing cap 25 and the sandwich cylinder 22.

Referring to FIGS. 2 and 3, preferably, the bottom of the sandwich cylinder 22 is recessed inward to form the fixing portion 227 corresponding to the first sealing ring 24, and the bottom of the first sealing ring 24 is bent and sandwiched between the fixing portion 227 and the sealing cap 25.

Referring to FIGS. 2 and 3, further, the first sealing ring 24 includes the sealing groove 243 formed at the top of the first sealing ring 24, and the first sealing strip 241 and the second sealing strip 242 formed on both sides of the sealing groove 243. The bottom of the outer layer cylinder 23 is provided with the protruding portion 232, and the protruding portion 232 is clamped in the sealing groove 243. The top of the outer wall of the sandwich cylinder 22 is provided with the flange 224 corresponding to the first sealing strip 241, and the first sealing strip 241 is sandwiched between the flange 224, the side wall of the sandwich cylinder 22 and the protruding portion 232.

Referring to FIGS. 4, 5, 6 and 7, preferably, the inner wall of the cup body 1 is provided with the waterproof rib 12 corresponding to the first sealing ring 24, and the first sealing ring 24 is squeezed to bulge outward to be tightly attached to the waterproof rib 12, thereby enhancing the sealing between the cup lid 2 and the cup body 1.

Referring to FIGS. 1, 4 and 5, in an embodiment of the present invention, the water cup further includes the third sealing ring 28 with elasticity. The top of the cylinder wall of the outer layer cylinder 23 is provided with the first blocking ring 234 and the second blocking ring 235 corresponding to the third sealing ring 28. The third sealing ring 28 is sleeved on the outer layer cylinder 23 and is sandwiched between the first blocking ring 234 and the second blocking ring 235. The top of the outer wall of the inner layer cylinder 21 is provided with the positioning plate 212, and the top of the cylinder wall of the outer layer cylinder 23 is provided with the positioning groove 236 corresponding to the positioning plate 212. An end portion of the positioning plate 212 passes through the positioning groove 236 and abuts against the third sealing ring 28. The cap shell 26 is rotated to drive the inner layer cylinder 21 to rotate, so that the positioning plate 212 can slide in the positioning groove 236. The side of the third sealing ring 28 away from the positioning plate 212 abuts against the cap shell 26. Such design enhances the sealing between the inner layer cylinder 21, the outer layer cylinder 23 and the cap shell 26, and prevents water from penetrating into the inner layer cylinder 21. Specifically, two positioning plates 212 are uniformly arranged, and two positioning grooves 236 are uniformly arranged.

Referring to FIGS. 4, 5, 6 and 7, preferably, the top of the cup body 1 is provided with the mounting portion 13, and a mounting groove is formed between the outer layer cylinder 23 and the cap shell 26. The mounting portion 13 is mounted in the mounting groove.

Referring to FIGS. 1 and 2, further, the bottom of the outer layer cylinder 23 is provided with the opening 2311 in communication with the connecting groove 231, and the width of the opening 2311 is smaller than the width of the connecting groove 231.

When the cup lid 2 is covered on the cup body 1, after the first sealing ring 24 is tightly attached to the inner wall of the cup body 1, the cap shell 26 is continuously rotated to enable the connecting piece 11 to move into the connecting groove 231 away from the opening 2311, so that the connecting piece 11 is restricted in the connecting groove 231.

When the cup lid 2 is screwed out of the cup body 1 and the protruding block 221 is located at the second end portion, the cap shell 26 is continuously rotated to enable the inner layer cylinder 21 to rotate to drive the sandwich cylinder 22 to rotate and further drive the outer layer cylinder 23 to rotate, so that the connecting piece 11 is separated from the connecting groove 231.

Referring to FIG. 1, further, the outer wall of the sandwich cylinder 22 is provided with the first limiting piece 225, and the inner wall of the outer layer cylinder 23 is provided with the first limiting groove 237 corresponding to the first limiting piece 225. The first limiting piece 225 is slidably disposed in the first limiting groove 237. The inner wall of the outer layer cylinder 23 is provided with the second limiting piece 238, and the cylinder wall of the sandwich cylinder 22 is provided with the second limiting groove 226 corresponding to the second limiting piece 238. The second limiting piece 238 is slidably disposed in the second limiting groove 226. By means of the cooperation between the first limiting piece 225 and the first limiting groove 237 and the cooperation between the second limiting piece 238 and the second limiting groove 226, the sandwich cylinder 22 can only move relative to the outer layer cylinder 23 along the first limiting groove 237 and the second limiting groove 226. Specifically, three first limiting pieces 225 are uniformly arranged, three first limiting grooves 237 are uniformly arranged, three second limiting pieces 238 are uniformly arranged, and three second limiting grooves 226 are uniformly arranged.

Preferably, two inclined grooves 211 are uniformly arranged, and the center angle projected by the inclined groove 211 on the horizontal plane is 90°. Two protruding blocks 221 are uniformly arranged.

Specifically, in an embodiment of the present invention, the cup lid 2 is provided with a handle hole.

The working process of the cup of the present invention is described below.

When the cup lid 2 is closed, the cup lid 2 extends into the cup body 1, so that the connecting piece 11 enters and is clamped in the connecting groove 231. The cap shell 26 is rotated forward to enable the inner layer cylinder 21 to rotate forward, and the protruding block 221 at the second end portion moves to the first end portion, so that the sandwich cylinder 22 drives the first sealing ring 24 to move upward and then squeezes the first sealing ring 24 to bulge outward, and the first sealing ring 24 is enabled to be tightly attached to the inner wall of the cup body 1. The cap shell 26 is continuously rotated to enable the connecting piece 11 to move into the connecting groove 231 away from the opening 2311, so that the connecting piece 11 is restricted in the connecting groove 231, thereby realizing that the cup lid 2 can be closed to the cup body 1 by rotating 90°.

When the cup lid 2 is opened, the cap shell 26 is rotated forward. The cap shell 26 is rotated to drive the inner layer cylinder 21 to rotate in the opposite direction, and the protruding block 221 at the first end portion moves toward the second end portion, so that the sandwich cylinder 22 drives the first sealing ring 24 to move downward and decompresses the first sealing ring 24, and the first sealing ring 24 is enabled to move away from the inner wall of the cup body 1. When the protruding block 221 is located at the second end portion, the inner layer cylinder 21 continues to rotate to drive the sandwich cylinder 22 to rotate and further drive the outer layer cylinder 23 to rotate, so that the connecting piece 11 is separated from the connecting groove 231, thereby realizing that the cup lid 2 can be screwed out of the cup body 1 by rotating 90°.

By adopting the above technical solutions, the present invention has the following advantages.

In the present invention, the connecting piece is clamped in the connecting groove to enable the outer layer cylinder to be restricted to the cup body. By means of the cooperation between the protruding block and the inclined groove, the inner layer cylinder drives the sandwich cylinder to move upward or downward to squeeze or decompress the first sealing ring, so that the first sealing ring is tightly attached to or moves away from the inner wall of the cup body. In this way, the cup lid can be opened or closed on the cup body by rotating at a small angle. In addition, the sealing cap can be mounted to or detached from the sandwich cylinder by rotating the sealing cap, so that the interior of the cup lid can be conveniently cleaned to prevent bacteria from breeding. Moreover, the sandwich cylinder moves upward and squeezes the first sealing ring to bulge outward, so that the first sealing ring can be tightly attached to the inner wall of the cup body, which increases the sealing of the cup lid covered on the cup body.

It should be noted that, the structure, proportion and size illustrated in the drawings are intended only to cooperate to describe the present invention, for those having ordinary skill in the art to understand and read, rather than to limit the present invention, and therefore have no technical substance. Any modification of structure, change of proportional relationship or adjustment of size should without affecting the efficacy and objectives that can be achieved by the present invention shall fall within the scope of the technical content disclosed by the present invention. Meanwhile, the terms such as "upper", "lower", "left", "right", "middle" and "a/an/one" quoted in the specification are for the convenience of description only, and are not used to restrict the implementable scope of the present invention, and the change or adjustment of their relative relationship shall be regarded as the implementable scope of the present invention without substantial change in the technical content.

The present invention has been described above in detail in combination with the drawings and embodiments, and those ordinarily skilled in the art may make various changes to the present invention according to the above description. Therefore, certain details of the embodiments should not constitute a limitation to the present invention, and the present invention will take the scope defined by the appended claims as the scope of protection of the present invention.

What is claimed is:

1. A cup, comprising:

a cup body, wherein an interior of the cup body is hollow, and a top of an inner wall of the cup body is provided with a connecting piece; and a cup lid, wherein the cup lid is covered on the cup body;

wherein the cup lid comprises:

an inner layer cylinder, a sandwich cylinder, wherein the sandwich cylinder is sleeved on the inner layer cylinder, an outer layer cylinder, wherein the outer layer cylinder is sleeved and clamped on an upper portion of the sandwich cylinder, a first sealing ring with an elasticity, wherein the first sealing ring is sleeved on a lower portion of the sandwich cylinder, a sealing cap, wherein the sealing cap is detachably mounted at a bottom of the sandwich cylinder, and a cap shell, wherein the cap shell is covered to the outer layer cylinder and the cap shell is fixedly connected to the inner layer cylinder;

a cylinder wall of the outer layer cylinder is provided with a connecting groove corresponding to the connecting piece;

the connecting piece is clamped in the connecting groove, and the cup lid is opened or closed on the cup body;

an inner wall of the sandwich cylinder is provided with a protruding block, and a cylinder wall of the inner layer cylinder is provided with an arc-shaped inclined groove corresponding to the protruding block;

the protruding block is slidably disposed in the arc-shaped inclined groove, and the sandwich cylinder is clamped in the inner layer cylinder;

the arc-shaped inclined groove comprises a first end portion and a second end portion, and a height of the first end portion is higher than a height of the second end portion;

the sandwich cylinder moves up and down relative to the outer layer cylinder;

a top of the first sealing ring is fixedly connected to a bottom of the outer layer cylinder, and a bottom of the first sealing ring is sandwiched and fixed between the bottom of the sandwich cylinder and the sealing cap;

the sealing cap is mounted to or detached from the sandwich cylinder by rotating the sealing cap;

wherein when the cup lid is covered on the cup body, the cup lid extends into the cup body, the connecting piece enters and is clamped in the connecting groove, the cap shell is rotated to drive the inner layer cylinder to rotate, the protruding block at the second end portion moves toward the first end portion, the sandwich cylinder drives the first sealing ring to move upward and squeezes the first sealing ring to bulge outward, and the first sealing ring is tightly attached to the inner wall of the cup body; and when the cup lid is screwed out of the cup body, the cap shell is rotated to drive the inner layer cylinder to rotate, the protruding block at the first end portion moves toward the second end portion, the sandwich cylinder drives the first sealing ring to move downward and decompresses the first sealing ring, and the first sealing ring moves away from the inner wall of the cup body to allow the cup lid to be pulled out of the cup body.

2. The cup according to claim 1, wherein the sealing cap comprises a base and a vertical cylinder erected on the base;

a top of an outer wall of the vertical cylinder is provided with a clamping strip;

the sandwich cylinder comprises a bottom plate, and the bottom plate is provided with an assembly hole, wherein the vertical cylinder passes through the assembly hole;

an inner wall of the assembly hole is provided with a sliding groove adapted to the clamping strip, and the sliding groove is inclined;

a first end of the sliding groove is located at a top surface of the bottom plate, and a second end of the sliding groove is provided with a clamping groove adapted to the clamping strip and facing downward;

wherein when the sealing cap is mounted to the sandwich cylinder, the vertical cylinder is inserted into the assembly hole, the sealing cap is rotated, the clamping strip enters the sliding groove, the clamping strip moves to the clamping groove along the sliding groove, and the clamping strip is clamped in the clamping groove; and when the sealing cap is detached from the sandwich cylinder, the sealing cap is rotated, the clamping strip is separated from the clamping groove, the clamping strip moves into the sliding groove, and the clamping strip is separated from the sliding groove.

3. The cup according to claim 1, further comprising a second sealing ring with the elasticity, wherein the bottom of the sandwich cylinder is provided with a clamping groove corresponding to the second sealing ring, and the second sealing ring is sandwiched and fixed between the clamping groove and the sealing cap.

4. The cup according to claim 1, wherein the bottom of the sandwich cylinder is recessed inward to form a fixing portion corresponding to the first sealing ring, and the bottom of the first sealing ring is bent and sandwiched between the fixing portion and the sealing cap.

5. The cup according to claim 1, wherein the first sealing ring comprises:

a sealing groove formed at the top of the first sealing ring, a first sealing strip, and a second sealing strip;

wherein the first sealing strip and the second sealing strip are formed on both sides of the sealing groove;

the bottom of the outer layer cylinder is provided with a protruding portion, and the protruding portion is clamped in the sealing groove; and a top of an outer wall of the sandwich cylinder is provided with a flange corresponding to the first sealing strip, and the first sealing strip is sandwiched between the flange, a side wall of the sandwich cylinder and the protruding portion.

6. The cup according to claim 1, wherein the inner wall of the cup body is provided with a waterproof rib corresponding to the first sealing ring, and the first sealing ring is squeezed to bulge outward to be tightly attached to the waterproof rib.

7. The cup according to claim 1, further comprising a third sealing ring with the elasticity, wherein a top of the cylinder wall of the outer layer cylinder is provided with a first blocking ring and a second blocking ring, wherein the first blocking ring and the second blocking ring correspond to the third sealing ring;

the third sealing ring is sleeved on the outer layer cylinder, and the third sealing ring is sandwiched between the first blocking ring and the second blocking ring;

a top of an outer wall of the inner layer cylinder is provided with a positioning plate, and the top of the cylinder wall of the outer layer cylinder is provided with a positioning groove corresponding to the positioning plate;

an end portion of the positioning plate passes through the positioning groove, and the end portion of the positioning plate abuts against the third sealing ring;

the cap shell is rotated to drive the inner layer cylinder to rotate, and the positioning plate slides in the positioning groove; and a side of the third sealing ring abuts against the cap shell, wherein the side of the third sealing ring is away from the positioning plate.

8. The cup according to claim 1, wherein a top of the cup body is provided with a mounting portion, a mounting groove is formed between the outer layer cylinder and the cap shell, and the mounting portion is mounted in the mounting groove.

9. The cup according to claim 1, wherein the bottom of the outer layer cylinder is provided with an opening in communication with the connecting groove, and a width of the opening is smaller than a width of the connecting groove;

the cup lid is rotated, the connecting piece enters the connecting groove through the opening and then moves away from the opening, and the connecting piece is restricted to the connecting groove to allow the cup lid to be covered on the cup body.

10. The cup according to claim 1, wherein the outer wall of the sandwich cylinder is provided with a first limiting piece, an inner wall of the outer layer cylinder is provided with a first limiting groove corresponding to the first limiting piece, and the first limiting piece is slidably disposed in the first limiting groove; and the inner wall of the outer layer cylinder is provided with a second limiting piece, a cylinder wall of the sandwich cylinder is provided with a second limiting groove corresponding to the second limiting piece, and the second limiting piece is slidably disposed in the second limiting groove.

11. The cup according to claim 4, wherein the inner wall of the cup body is provided with a waterproof rib corresponding to the first sealing ring, and the first sealing ring is squeezed to bulge outward to be tightly attached to the waterproof rib.

12. The cup according to claim 5, wherein the inner wall of the cup body is provided with a waterproof rib corresponding to the first sealing ring, and the first sealing ring is squeezed to bulge outward to be tightly attached to the waterproof rib.

* * * * *